US012570492B2

(12) United States Patent
Akira et al.

(10) Patent No.: US 12,570,492 B2
(45) Date of Patent: Mar. 10, 2026

(54) PAPER FEED ROLL

(71) Applicant: Sumitomo Riko Company Limited, Aichi (JP)

(72) Inventors: Naoki Akira, Aichi (JP); Manabu Sakuda, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 51 days.

(21) Appl. No.: 18/628,838

(22) Filed: Apr. 8, 2024

(65) Prior Publication Data

US 2024/0270530 A1 Aug. 15, 2024

Related U.S. Application Data

(63) Continuation of application No. PCT/JP2022/039099, filed on Oct. 20, 2022.

(30) Foreign Application Priority Data

Dec. 24, 2021 (JP) ..... 2021-210694

(51) Int. Cl.
*B65H 27/00* (2006.01)

(52) U.S. Cl.
CPC ..... *B65H 27/00* (2013.01); *B65H 2401/111* (2013.01); *B65H 2801/09* (2013.01)

(58) Field of Classification Search
CPC ..... B65H 27/00; B65H 2401/111; B65H 2404/185
See application file for complete search history.

(56) References Cited

U.S. PATENT DOCUMENTS 8,807,554 B2 * 8/2014 Mine ..... B65H 27/00 492/30
8,900,108 B2 12/2014 Mine et al.
(Continued)

FOREIGN PATENT DOCUMENTS

JP 2011116480 6/2011
JP 2013091557 5/2013
(Continued)

OTHER PUBLICATIONS

"International Search Report (Form PCT/ISA/210) of PCT/JP2022/039099", mailed on Dec. 27, 2022, with English translation thereof, pp. 1-4.
(Continued)

*Primary Examiner* — Howard J Sanders
(74) *Attorney, Agent, or Firm* — JCIPRNET

(57) ABSTRACT

The present disclosure provides a paper feed roll that inhibits conveyance failure even during long term use by suppressing unevenness in the surface of an elastic material layer when the elastic material layer is formed by two or more phases. A paper feed roll 10 according to the present disclosure is provided with a shaft body 12 and an elastic material layer 14 formed on the outer peripheral surface of the shaft body 12. The elastic material layer 14 includes a first phase containing ethylene propylene diene rubber and a second phase containing one or more of either isoprene rubber or natural rubber. The area ratio of the second phase is within the range of 30% or more and 70% or less in a range of any given 2.5 μm×2.5 μm square of the elastic material layer 14.

5 Claims, 2 Drawing Sheets

(56) References Cited

U.S. PATENT DOCUMENTS

| | | | | |
|---|---|---|---|---|
| 9,637,623 | B2 | 5/2017 | Mine et al. | |
| 9,639,025 | B2 * | 5/2017 | Marui | G03G 15/0808 |
| 11,215,937 | B2 * | 1/2022 | Nakazato | F16C 13/00 |
| 2013/0109553 | A1 * | 5/2013 | Mine | C08L 23/16 525/122 |

FOREIGN PATENT DOCUMENTS

| | | |
|---|---|---|
| JP | 2014196428 | 10/2014 |
| JP | 2020002272 | 1/2020 |
| WO | 2021020495 | 2/2021 |

OTHER PUBLICATIONS

"International Preliminary Report on Patentability (Form PCT/IPEA/409) of PCT/JP2022/039099", mailed on Jun. 24, 2024, with English translation thereof, pp. 1-8.

"Office Action of Japan Counterpart Application", issued on Aug. 5, 2025, with English translation thereof, pp. 1-6.

* cited by examiner

PAPER FEED ROLL

CROSS-REFERENCE TO RELATED APPLICATION

This application is a continuation of PCT International Application No. PCT/JP2022/039099, filed on Oct. 20, 2022, which claims priority under 35 U.S.C § 119(a) to Japanese Patent Application No. 2021-210694, filed on Dec. 24, 2021. Each of the above application(s) is hereby expressly incorporated by reference, in its entirety, into the present application.

BACKGROUND

Technical Field

The disclosure relates to a paper feed roll that is suitably used in an electrophotographic apparatus such as a copy machine, a printer, and a facsimile, that employs electrophotography.

Description of Related Art

As a paper feed roll, a paper feed roll having an elastic material layer formed by an elastic material such as a crosslinked rubber body on an outer circumferential surface of a shaft body such as a core bar is known. As an elastic material of the elastic material layer, the use of ethylene propylene diene rubber and isoprene rubber or styrene butadiene rubber, etc., in combination is known (Patent Document 1).

PRIOR ART DOCUMENT(S)

Patent Document(s)

Patent Document 1: Japanese Laid-open No. 2014-196428

In the case where an elastic material of an elastic material layer is formed by two or more polymer components, the elastic material layer is often formed by two or more phases having different polymer components. Since the polymer components are different, the amount of wear and the amount of attached paper dust differ from one phase to another. As a result, after long-term use, the difference in the friction coefficient between phases increases, and the surface of the elastic material layer tends to have a non-uniform friction coefficient. When the friction coefficient of the surface of the elastic material layer becomes non-uniform, an issue arises that paper cannot be conveyed straight, resulting in conveyance failure (paper jam).

The disclosure provides a paper feed roll that inhibits conveyance failure even during long term use by suppressing the unevenness of the surface of an elastic material layer when the elastic material layer is formed by two or more phases.

SUMMARY

A paper feed roll according to the disclosure includes: a shaft body; an elastic material layer, formed on an outer circumferential surface of the shaft body. The elastic material layer has a first phase that contains ethylene propylene diene rubber and a second phase that contains one or more of either isoprene rubber or natural rubber. An area ratio of the second phase is within a range of 30% or more and 70% or less in any given 2.5 μm×2.5 μm square of the elastic material layer.

DESCRIPTION OF THE EMBODIMENTS

Figure 1A:
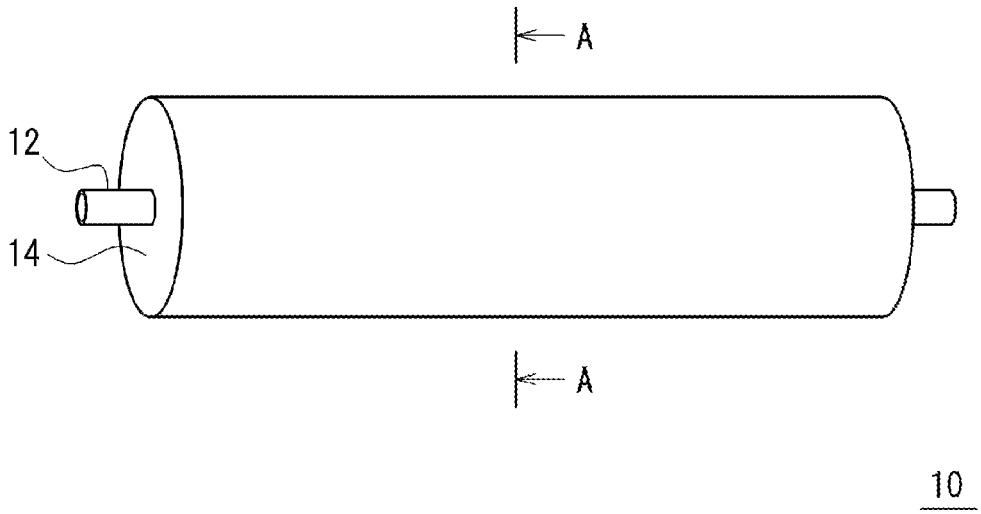
FIG. 1A is a schematic view illustrating the appearance of a paper feed roll according to an embodiment of the disclosure.

A paper feed roll according to the disclosure includes: a shaft body; an elastic material layer, formed on an outer circumferential surface of the shaft body. The elastic material layer has a first phase that contains ethylene propylene diene rubber and a second phase that contains one or more of either isoprene rubber or natural rubber. An area ratio of the second phase is within a range of 30% or more and 70% or less in any given 2.5 μm×2.5 μm square of the elastic material layer.

According to an embodiment, it may also be that the elastic material layer further contains a polymer having a partial structure of ethylene propylene diene rubber and a partial structure of either isoprene rubber or natural rubber. According to an embodiment, it may also be that the partial structure of ethylene propylene diene rubber is an ethylene propylene structure. According to an embodiment, it may also be that the elastic material layer contains hydrocarbon oil. According to an embodiment, it may also be that the ethylene propylene diene rubber contains both oil extended ethylene propylene diene rubber and non-oil extended ethylene propylene diene rubber.

According to the paper feed roll according to the embodiments of the disclosure, the paper feed roll includes: a shaft body; an elastic material layer, formed on an outer circumferential surface of the shaft body. The elastic material layer has a first phase that contains ethylene propylene diene rubber and a second phase that contains one or more of either isoprene rubber or natural rubber. Therefore, an area ratio of the second phase is within a range of 30% or more and 70% or less in any given 2.5 μm×2.5 μm square of the elastic material layer. When the elastic material layer is formed by two or more phases, conveyance failures can be suppressed even during long term use by suppressing unevenness in the surface of the elastic material layer.

When the elastic material layer further contains a polymer having a partial structure of ethylene propylene diene rubber and a partial structure of either isoprene rubber or natural rubber, the dispersibility of the second phase with respect to the first phase is further improved. Accordingly, the friction coefficient of the surface of the elastic material layer becomes further uniform, and the effect of suppressing conveyance failures during long term use is improved.

In addition, when the partial structure of ethylene propylene diene rubber is an ethylene propylene structure, the dispersibility of the second phase with respect to the first phase is further improved. Accordingly, the friction coefficient of the surface of the elastic material layer becomes further uniform, and the effect of suppressing conveyance failures during long term use is improved.

When the elastic material layer contains hydrocarbon oil, the compatibility between the first phase and the second phase is increased, and the dispersibility of the second phase with respect to the first phase is improved. Accordingly, the friction coefficient of the surface of the elastic material layer becomes further uniform, and the effect of suppressing conveyance failures during long term use is improved.

When the ethylene propylene diene rubber contains both oil extended ethylene propylene diene rubber and non-oil extended ethylene propylene diene rubber, since sufficient shear is applied at the time of rubber kneading processing, the dispersibility of the second phase with respect to the first phase is improved. Accordingly, the friction coefficient of the surface of the elastic material layer becomes further uniform, and the effect of suppressing conveyance failures during long term use is improved.

Figure 1B:
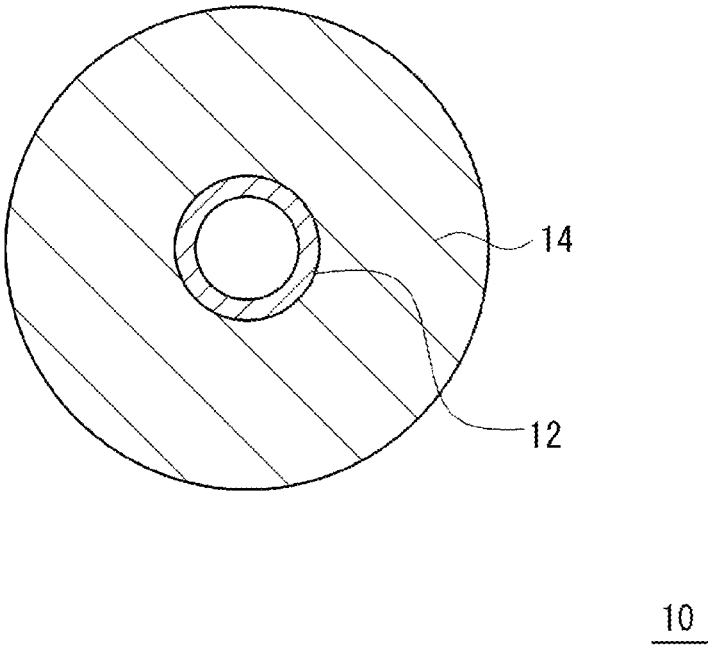
FIG. 1B is a cross-sectional view taken along a line A-A.

A paper feed roll according to the disclosure is described in detail. FIG. 1A is a schematic view illustrating the appearance of a paper feed roll according to an embodiment of the disclosure, and FIG. 1B is a cross-sectional view taken along a line A-A.

A paper feed roll 10 according to an embodiment of the disclosure includes a shaft body 12, and an elastic material layer 14 formed on the outer peripheral surface of the shaft body 12. The elastic material layer 14 is a layer (base layer) forming the base of the paper feed roll 10. The elastic material layer 14 is a layer that appears on the top surface of the paper feed roll 10.

The shaft body 12 may be a solid body or a hollow body (cylindrical body) made of metal or resin. Examples of metal materials include iron, stainless steel, aluminum, etc. The elastic material layer 14 may also be bonded to the shaft body 12 via an adhesive layer (primer layer). The adhesive, the primer, etc., may be made conductive if necessary.

The elastic material layer 14 has a first phase that contains ethylene propylene diene rubber and a second phase that contains one or more of either isoprene rubber or natural rubber. The area ratio of the second phase is within the range of 30% or more and 70% or less in any given 2.5 μm×2.5 μm square.

In the elastic material layer 14, ethylene propylene diene rubber (EPDM) is suitable for controlling the hardness of the elastic material layer 14 within a desired range. The one or more of either the isoprene rubber (IR) or the natural rubber (NR) is a material with a high friction coefficient than ethylene propylene diene rubber, and is suitable for improving the paper feeding properties of ethylene propylene diene rubber whose friction coefficient is relatively low. The two phases, i.e., the first phase and the second phase, are dispersed (finely dispersed) uniformly in the elastic material layer 14, so that the area ratio of the second phase is within the range of 30% or more and 70% or less in a very narrow range of any given 2.5 μm×2.5 μm square. Therefore, the friction coefficient of the surface of the elastic material layer becomes uniform rather than non-uniform depending on portions, and conveyance failures can be suppressed even during long term use.

In addition, the area ratio of the second phase is more preferably 35% or more and 65% or less, and more preferably 40% or more and 60% or less. The area ratio of the first phase and the second phase can be measured by performing a surface analysis using a scanning probe microscopy (SPM).

Figure 2:
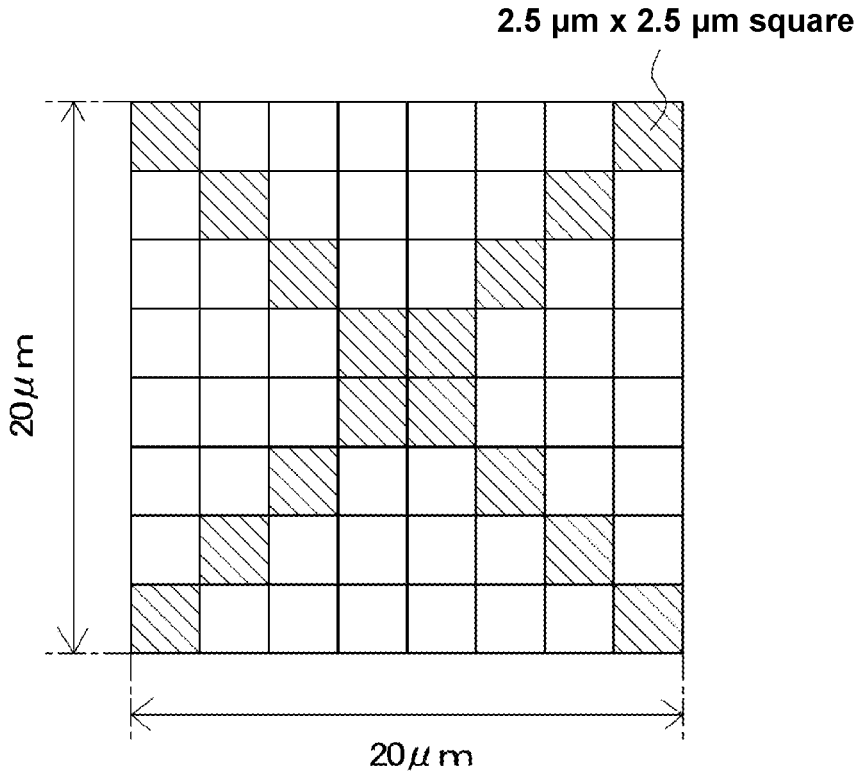
FIG. 2 is a schematic view illustrating a method for measuring an area ratio of two phases, i.e., a first phase and a second phase, in an elastic material layer.

The expression "any given" refers to "anywhere". The area ratio of the first phase and the second phase is in any given 2.5 μm×2.5 μm square. Nevertheless, specifically, as shown in FIG. 2, an arbitrary surface of the elastic material layer is observed, an arbitrary range of 20×20 μm on the surface is divided into 64, 16 squares arranged in diagonal directions in which diagonal lines are drawn are selected, the area ratio of the first phase and the second phase in each 2.5 μm×2.5 μm square is measured, and 14 out of 16 squares (85% or more) that are selected have the corresponding value. Photographing by using the scanning probe microscopy (SPM) is performed at four positions at each of the left end, the central part, and the right end (12 positions in total) in the axial direction of the elastic material layer.

For uniformly dispersing (finely dispersing) the two phases, i.e., the first and second phases, in the arbitrary 2.5 μm×2.5 μm square, for example, a method such as adjusting the blending ratio of the polymers of the first phase and the second phase, thoroughly kneading to the desired dispersion degree, and using a dispersant that improves the dispersibility of the two phases i.e., the first and second phases, is considered.

A ratio of the polymers of the first phase and the second phase is preferably within a range of first phase: second phase=3:1 to 1:3 in terms of mass ratio. More preferably, the ratio is within a range of first phase:second phase=2.5:1 to 1:2.5, and even more preferably, the ratio is within a range of first phase:second phase=2:1 to 1:2.

As conditions of kneading the polymers of the first phase and the second phase, the rotation speed is preferably 30 rpm or higher, and the kneading time is preferably 5 minutes or more, so as to achieve the area ratio. More preferably, the rotation speed is 40 rpm or higher, and the kneading time is 10 minutes or more.

The ethylene propylene diene rubber is obtained by copolymerizing a non-conjugated diene as a third component with ethylene propylene rubber (EPM), which is a copolymer of ethylene and propylene. Ethylene propylene diene rubber has an ethylene propylene structure or a structure resulting from the non-conjugated diene in the molecular structure. Examples of the non-conjugated diene of the ethylene propylene diene rubber include ethylidene norbornene (ENB), 1,4-hexadiene (1,4-HD), dicyclopentadiene (DCPD), etc.

The ethylene propylene diene rubber may be oil extended ethylene propylene diene rubber, and may also be non-oil extended ethylene propylene diene rubber. The ethylene propylene diene rubber may also contain both oil extended ethylene propylene diene rubber and non-oil extended ethylene propylene diene rubber. From the perspective of easy application of sufficient shear at the time of rubber kneading processing and improving the dispersibility of the second phase with respect to the first phase, etc., the ethylene propylene diene rubber preferably contains both oil extended ethylene propylene diene rubber and non-oil extended ethylene propylene diene rubber. From the perspective of easy application of sufficient shear at the time of rubber kneading processing, the ratio of oil extended ethylene propylene diene rubber and non-oil extended ethylene propylene diene rubber is preferably within a range of oil extended: non-oil extended=5:1 to 2:1 in terms of mass ratio. More preferably, the ratio of oil extended ethylene propylene diene rubber and non-oil extended ethylene propylene diene rubber is within the range of oil extended: non-oil extended=4:1 to 2:1.

As the oil for oil extension, the oil is not particularly limited, as long as it is oil blended with ethylene propylene diene rubber, but is preferably paraffin oil, naphthenic oil, etc.

As the dispersant, examples include a polymer having a partial structure of ethylene propylene diene rubber and a partial structure of either isoprene rubber or natural rubber, modified natural rubber, modified isoprene rubber, etc. As the modified natural rubber, examples include epoxidized natural rubber, chlorinated natural rubber, nitrilated natural rubber (acrylonitrile natural rubber), etc. As the modified isoprene rubber, examples include epoxidized isoprene rubber, chlorinated isoprene rubber, nitrilated isoprene rubber (acrylonitrile isoprene rubber), maleic acid modified isoprene rubber, (meth)acrylic acid modified isoprene rubber, etc. As the dispersant, the clastic material layer 14 may also include a polymer having a partial structure of ethylene propylene diene rubber and a partial structure of either isoprene rubber or natural rubber. Examples of the partial structure of ethylene propylene diene rubber include an ethylene propylene structure, a structure due to diene, etc. As the partial structure of ethylene propylene diene rubber, the ethylene propylene structure is particularly preferred. Examples of the partial structure of isoprene rubber and natural rubber include an isoprene structure. From the perspective of easy fixture through crosslinking, etc., the dispersant preferably has a double bond.

As the polymer having the partial structure of ethylene propylene diene rubber and the partial structure of either isoprene rubber or natural rubber, examples include a block copolymer of ethylene propylene diene rubber and isoprene rubber, a block copolymer of ethylene propylene diene rubber and natural rubber, and hydrogenated isoprene rubber in which a portion of isoprene rubber, etc., is hydrogenated. Examples of hydrogenated isoprene rubber include, for example, "LIR-290" manufactured by Kuraray.

From the perspective of attaining an excellent effect of dispersing the first phase and the second phase, the content of the dispersant is preferably 1.0 part by mass or more with respect to 100 parts by mass of the polymers of the first phase and the second phase. More preferably, the content of the dispersant is more preferably 1.5 parts by mass or more, and even more preferably 2.0 parts by mass or more. From the perspective of easily maintaining the physical properties of the first phase and the second phase, the content of the dispersant is preferably 10 parts by mass or less with respect to 100 parts by mass of the polymers of the first phase and the second phase. More preferably, the content of the dispersant is more preferably 7.0 parts by mass or less, and even more preferably 5.0 parts by mass or less.

The elastic material layer 14 preferably further contains hydrocarbon oil. Accordingly, the effect of dispersing the first phase and the second phase is obtained easily. Examples of the hydrocarbon oil include paraffin oil, for example. From the perspective of improving the dispersibility of the first phase and the second phase, the content of the hydrocarbon oil is preferably 10 parts by mass or more with respect to 100 parts by mass of the polymers of the first phase and the second phase. More preferably, the content of the hydrocarbon oil is more preferably 15 parts by mass or more, and even more preferably 20 parts by mass or more. In addition, from the perspective of suppressing bleed-out of the hydrocarbon oil, the content of the hydrocarbon oil is preferably 50 parts by mass or less with respect to 100 parts by mass of the polymers of the first phase and the second phase. More preferably, the content of the hydrocarbon oil is more preferably 45 parts by mass or less, and even more preferably 40 parts by mass or less.

From the perspective of securing a paper feeding function, etc., the friction coefficient of the surface of the clastic material layer 14 is preferably configured within the range of 0.8 to 3.0. More preferably, the friction coefficient is configured within the range of 1.0 to 2.5 The surface of the elastic material layer 14 is the outer peripheral surface of the elastic material layer 14. The friction coefficient of the surface of the elastic material layer 14 can be measured by using a commercially available friction coefficient meter. The friction coefficient of the surface of the elastic material layer 14 can be adjusted according to the material configuration of the elastic material layer 14.

The JIS-A hardness of the surface of the elastic material layer 14 preferably falls within the range of 20 degrees to 80 degrees. More preferably, the JIS-A hardness of the surface of the elastic material layer 14 falls within the range of 30 degrees to 70 degrees. The surface of the elastic material layer 14 is the outer peripheral surface of the elastic material layer 14. The hardness of the surface of the elastic material layer 14 can be adjusted according to the material configuration of the elastic material layer 14, the thickness of the elastic material layer 14, etc. When the JIS-A hardness of the surface of the elastic material layer 14 is 20 degrees or more, wear is easily suppressed. When the JIS-A hardness of the surface of the elastic material layer 14 is 80 degrees or less, the damage to paper (e.g., paper scratch) is easily suppressed, and the image quality is easily suppressed from deteriorating.

The surface of the elastic material layer 14 may also be textured, such as being embossed. The surface texture of the elastic material layer 14 may also be formed through a process such as polishing, mold transfer.

The thickness of the elastic material layer 14 is not particularly limited, but may be 1 to 10 mm.

The elastic material layer 14 can be manufactured as follows, for example. Firstly, the shaft body 12 is disposed coaxially with a hollow part of a roll molding die. An uncrosslinked rubber composition is injected and heated/cured (crosslinked). Then, by demolding or extruding the uncrosslinked rubber composition on the surface of the shaft body 12, the elastic material layer 14 is formed on the outer periphery of the shaft body 12.

Where necessary, the uncrosslinked rubber composition forming the elastic material layer 14 may suitably contain a crosslinking agent, a conductive agent, a foaming agent, a surfactant, a flame retardant, a colorant, a filler, a stabilizer, a mold release agent, etc.

Examples of the crosslinking agent can include a sulfur crosslinking agent, a peroxide crosslinking agent, etc. The crosslinking agents may be used alone, or two or more of the crosslinking agents may be used in combination.

As the sulfur crosslinking agent, examples of conventional sulfur crosslinking agents include powdered sulfur, precipitated sulfur, colloidal sulfur, surface-treated sulfur, insoluble sulfur, sulfur chloride, thiuram vulcanization accelerator, polymer polysulfide, etc.

As the peroxide crosslinking agent, examples of conventional peroxide crosslinking agents include peroxyketal, dialkyl peroxide, peroxy ester, ketone peroxide, peroxydicarbonate, diacyl peroxide, hydroperoxide, etc.

From the perspective such as making bleeding difficult, with respect to 100 parts by mass of the uncrosslinked rubber, the blending amount of the crosslinking agent is preferably within 0.1 to 4 parts by mass, more preferably within 0.3 to 3 parts by mass, and even more preferably within 0.5 to 2.5 parts by mass.

According to the paper feed roll with the above configuration, the elastic material layer 14 has the first phase containing ethylene propylene diene rubber and the second phase containing one or more of either the isoprene rubber or the natural rubber. In addition, the area ratio of the second phase is within the range of 30% or more and 70% or less in the range of any given 2.5 μm×2.5 μm square. Therefore, the two phases, i.e., the first phase and the second phase, are uniformly dispersed (finely dispersed) in the elastic material layer 14. Thus, the friction coefficient of the surface of the elastic material layer is uniform, instead of being non-uniform depending on portions. Even if the polymer components are different, and the amount of wear and the amount of attached paper dust differ from one phase to another, the friction coefficient of the surface of the elastic material layer does not become non-uniform. Accordingly, the issue that paper cannot be conveyed straight after long term use, resulting in conveyance failure (paper jam), is dissolved, and conveyance failures can be suppressed even during long term use.

The paper feed roll 10 is suitable for a feed roll or a retardation roll (separation roll), or a pickup roll (retraction roll) in a paper feed device.

Although the embodiments of the disclosure have been described above, the disclosure is not limited to the embodiments, and various modifications can be made without departing from the spirit of the disclosure.

EXAMPLES

In the following, the disclosure is described in detail by using examples and comparative examples.

Example 1

<Preparation of Rubber Composition>

A rubber composition was prepared by kneading, in a kneader, 60 parts by mass of oil extended EPDM, 20 parts by mass of non-oil extended EPDM, 50 parts by mass of IR, 30 parts by mass of paraffin oil, 3 parts by mass of the dispersant, 5 parts by mass of zinc oxide, 0.25 parts by mass of carbon black, 5 parts by mass of silica, and 3 parts by mass of a peroxide crosslinking agent.

<Preparation of Elastic Material Layer>

A core bar (with a diameter of 8 mm) was set in a molding die. The rubber composition was injected. The molding die was cooled and demolded after being heated for 40 minutes at 160° C. An elastic material layer formed by a rubber elastic material with a thickness of 6 mm was formed on the outer periphery of the core bar.

Examples 2 to 7

Rubber compositions like Example 1 were prepared by using the blending compositions (parts by mass) as shown in Table 1, and elastic material layers were formed.

Comparative Examples 1 to 2

Rubber compositions like Example 1 were prepared by using the blending compositions (parts by mass) as shown in Table 1, and elastic material layers were formed.

Materials that were used are as follows:

- Oil extended EPDM: "Esplen 600F" made by Sumitomo Chemical
- Non-oil extended EPDM: "Esplen 512F" made by Sumitomo Chemical
- IR: "Nipol IR2200" manufactured by Zeon Corporation
- NR: RSS #3
- Paraffin oil: "Diana Process PS-430" manufactured by Idemitsu Kosan
- Naphthene oil: "Diana Process NS-100" manufactured by Idemitsu Kosan
- Dispersant: "LIR-290" manufactured by Kuraray (hydrogenated isoprene)
- Zinc oxide: Reagent
- Carbon black: "Show Black MAF-G" manufactured by Cabot
- Silica: "Nipsil VN3" manufactured by Tosoh Silica
- Peroxide crosslinking agent: "Percmil D" manufactured by NOF CORPORATION The area ratio of the elastic material layer was measured for the manufactured paper feed roll. In addition, an initial friction coefficient of the elastic material layer was measured. In addition, actual evaluation was performed.

(Area Ratio)

Measurements were made by using a scan-type probe microscope (manufactured by Shimadzu Corporation "SPM-9700"). As shown in FIG. 2, an arbitrary surface of the elastic material layer was observed, an arbitrary range of 20×20 μm on the surface was divided into 64, 16 squares arranged in diagonal directions in which diagonal lines are drawn were selected, the area ratio of the first phase and the second phase in each 2.5 μm×2.5 μm square was measured, and 14 out of 16 squares (85% or more) that were selected had the corresponding value.

- Measurement positions: Four positions at each of the left end, the central part, and the right end (12 positions in total) of the elastic material layer
- Cantilever: SI-DF40
- Scan range: 5.0000 μm
- Scan speed: 1.00 Hz (Friction Coefficient)

Between the paper feed roll and a polytetrafluoroethylene board, a piece of paper (P paper of Fuji Xerox) in the size of 60 mm×210 mm connected with a load cell was sliced, a vertical load W (W=250 gf) was applied to the rotation shaft of the paper feed roll, and the paper feed roll was pressed against the polytetrafluoroethylene board. Then, under the conditions of temperature 23° C. and humidity 55%, the paper feed roll was rotated at a circumferential speed of 300 mm/sec. Before and after the paper passed through, a conveyance force F(gf) of a paper 24 that was generated was measured by using the load cell, a friction coefficient μ was obtained by using Formula 1 as follows according to F(gf) and the load W (W=250 gf). An initial friction coefficient equal to or greater than 1.5 was labeled as "◎", an initial friction coefficient equal to or greater than 1.0 and less than 1.5 was labeled as "○", and an initial friction coefficient less than 1.0 was labeled as "x".

$$\mu = F(gf)/W(gf) \quad \text{(Formula 1)}$$

(Actual Evaluation)

The paper feed roll was assembled to a commercially available copy machine having an FRR-type paper feed system, and paper feeding properties were evaluated. Commercially available PPC paper was used as the paper, 300,000 sheets (300K sheets) were passed, and the number of paper jams was measured. The number of paper jams equal to or less than one was labeled as "○○", the number of paper jams equal to or more than 2 and equal to or less than 5 was labeled as "○", the number of paper jams equal to or more than 6 and equal to or less than 10 was labeled as "x", and the number of paper jams of 11 was labeled as "xx". In addition, in the case where paper jams occurred 11 times, the durability evaluation was terminated.

TABLE 1

| | Example | | | | | | | Comparative Example | |
|---|---|---|---|---|---|---|---|---|---|
| | 1 | 2 | 3 | 4 | 5 | 6 | 7 | 1 | 2 |
| Oil extended EPDM | 60 | 60 | — | — | 60 | 60 | 60 | — | 100 |
| Non-oil extended EPDM | 20 | 20 | 50 | 50 | 20 | 20 | 40 | 50 | 0 |
| IR | 50 | 50 | 50 | 50 | 50 | — | 30 | 50 | 50 |
| NR | — | — | — | — | — | 50 | — | — | — |
| Paraffin oil | 30 | 30 | 30 | — | 30 | 30 | 30 | 60 | 10 |
| Naphthene oil | — | — | — | 30 | — | — | — | — | — |
| Dispersant | 3 | — | — | — | — | — | — | — | — |
| Zinc oxide | 5 | 5 | 5 | 5 | 5 | 5 | 5 | 5 | 5 |
| Carbon black | 0.25 | 0.25 | 0.25 | 0.25 | 0.25 | 0.25 | 0.25 | 0.25 | 0.25 |
| Silica | 5 | 5 | 5 | 5 | 5 | 5 | 5 | 5 | 5 |
| Peroxide crosslinking agent | 3 | 3 | 3 | 3 | 3 | 3 | 3 | 3 | 3 |
| Kneading condition (rpm/min) | 50/10 | 50/10 | 50/10 | 50/10 | 40/5 | 50/10 | 50/10 | 40/5 | 20/1 |
| Area ratio ($2^{nd}$ phase) | 45-55 | 40~60 | 35~65 | 30~70 | 30~70 | 30~70 | 30~45 | 0~100 | 0~100 |
| Initial friction coefficient | ○ | ○ | ○ | ○ | ○ | ○ | ○ | ○ | ○ |
| Actual evaluation | ○○ | ○ | ○ | ○ | ○ | ○ | ○ | x | x |

In Comparative Example 1, although the polymer of the elastic material layer was formed by EPDM and IR, the EPDM was formed by non-oil extended EPDM only, and, in a very narrow range of the 2.5 μm×2.5 μm square, areas where the second phase was not included or only the second phase was included were observed, and the friction coefficient of the surface of the elastic material layer was not uniform. In addition, in actual evaluation, during long-term use with a paper feed capacity of 300,000 sheets, there were many cases where the paper could not be conveyed straight, and thus many conveyance failures (paper jams) occurred. In Comparative Example 2 as well, although the polymer of the elastic material layer was formed by EPDM and IR, the EPDM was formed by oil extended EPDM only, and, in a very narrow range of the 2.5 μm×2.5 μm square, areas where the second phase was not included or only the second phase was included were observed, and the friction coefficient of the surface of the elastic material layer was not uniform. In addition, in actual evaluation, during long-term use with a paper feed capacity of 300,000 sheets, there were many cases where the paper could not be conveyed straight, and thus many conveyance failures (paper jams) occurred.

Comparatively, in the examples, the polymer of the elastic material layer was formed by EPDM and IR, and, in a very narrow range of the 2.5 μm×2.5 μm square, no areas where the second phase was not included or only the second phase was included were observed at any location, the area ratio of the second phase was within the appropriate range, and the friction coefficient of the surface of the elastic material layer was uniform. In addition, in actual evaluation, during the long-term use of 300,000 sheets, there were almost no cases where the paper could not be conveyed straight, and there were almost no conveyance failures (paper jams). In particular, in the example using a dispersant, the range of the area ratio of the second phase fell within a narrower range, and the friction coefficient of the surface of the elastic material layer was further unified, and the effect of suppressing conveyance failures (paper jams) was more excellent in actual evaluation.

Although the examples/embodiments of the disclosure have been described above, the disclosure is not limited to the examples/embodiments, and various modifications can be made without departing from the spirit of the disclosure.

What is claimed is:

1. A paper feed roll, containing:

a shaft body; an elastic material layer, formed on an outer circumferential surface of the shaft body, the elastic material layer appearing on a top surface, wherein the elastic material layer has a first phase that contains ethylene propylene diene rubber and a second phase that contains one or more of either isoprene rubber or natural rubber, a mass ratio of the first phase and the second phase is in a range of 2:1 to 1:2, and an area ratio of the second phase is within a range of 30% or more and 70% or less in any given 2.5 μm×2.5 μm square of the elastic material layer, and a friction coefficient of a surface of the elastic material layer is 1.0 to 2.5.

2. The paper feed roll as claimed in claim 1, wherein the elastic material layer further contains a polymer having a partial structure of ethylene propylene diene rubber and a partial structure of either isoprene rubber or natural rubber.

3. The paper feed roll as claimed in claim 2, wherein the partial structure of ethylene propylene diene rubber is an ethylene propylene structure.

4. The paper feed roll as claimed in claim 1, wherein the elastic material layer contains hydrocarbon oil.

5. The paper feed roll as claimed in claim 1, wherein the ethylene propylene diene rubber contains both oil extended ethylene propylene diene rubber and non-oil extended ethylene propylene diene rubber.

* * * * *